United States Patent [19]

Sotheran et al.

[11] 4,249,373

[45] Feb. 10, 1981

[54] GAS TURBINE ENGINE

[75] Inventors: Arthur Sotheran; David H. Parnell, both of Bristol, England

[73] Assignee: Rolls-Royce Ltd., London, England

[21] Appl. No.: 5,242

[22] Filed: Jan. 22, 1979

[30] Foreign Application Priority Data

Jan. 28, 1978 [GB] United Kingdom ..... 3548/78

[51] Int. Cl.[3] ..... F23R 3/30; F23R 3/50

[52] U.S. Cl. ..... 60/39.36; 60/738; 60/39.82 P

[58] Field of Search ..... 60/39.36, 39.71, 39.82 P, 60/738; 431/247

[56] References Cited

U.S. PATENT DOCUMENTS

| | | | |
|---|---|---|---|
| 2,931,174 | 4/1960 | Allen | 60/39.71 |
| 3,430,443 | 3/1969 | Richardson et al. | 60/738 |

FOREIGN PATENT DOCUMENTS

| | | | |
|---|---|---|---|
| 650608 | 2/1951 | United Kingdom | 60/39.71 |

*Primary Examiner*—James J. Gill

*Attorney, Agent, or Firm*—Stevens, Davis, Miller & Mosher

[57] ABSTRACT

A gas turbine engine comprises an annular combustion chamber (13) intended for low nitrogen oxide emission. The chamber has a pre-mixing section (20) in which an air-fuel mixture is brought to a significant degree of vaporization before issuing through a grill (22) at the end of the pre-mixing section into a main section (21) of the chamber. Pilot sections (18,19) at opposite sides of the pre-mixing section have outlets (28,29) through which burning mixture from the pilot sections is discharged into main section (21). The grill (22) defines openings (35) through which the fresh mixture from the pre-mixing section (20) is discharged across the outlets (28,29) of the pilot sections (18,19) to mix with and become ignited by the burning mixture.

The pre-mixing section (20) is an annular duct (33) having walls (15,16) which extend in the direction of the axis of the chamber and are straight in that direction though slightly convergent. The arrangement favors vaporization in the duct without auto-ignition.

4 Claims, 4 Drawing Figures

GAS TURBINE ENGINE

DESCRIPTION

This invention relates to gas turbine engines and is concerned with reducing the emission of nitrogen oxide from the combustion system of such engines.

It is known that nitrogen oxide emission during combustion of a mixture of air and liquid hydrocarbon fuel is a function of the combustion temperature. It has therefore been suggested to burn relatively lean such mixtures, i.e. mixtures having a less than stoichiometric fuel content. This lowers the combustion temperature and thus the nitrogen oxide emission. It is also known that such "cool" burning requires a good degree of vaporization of the fuel before combustion is allowed to take place because, to the extent that droplets of liquid fuel are present in the mixture, the burning at the surface of such droplets amounts to burning of stoichiometric mixture and as such takes place at temperatures favouring high nitrogen oxide emission. It has therefore been suggested to provide a combustion chamber with a pre-mixing section in which a lean air-fuel mixture can be taken to a significant degree of vaporization before the mixture issues from that section into a main section where the mixture is ignited and burnt. However, considerable difficulty has been experienced with premature ignition of the mixture in the pre-mixing section. It is an object of this invention to overcome or reduce this difficulty.

It is also known to provide said combustion chamber with a pilot section having an output of burning gases which mix with and ignite the fresh mixture from the pre-mixing section. It is a further object of this invention to provide an improvement in the mixing of the pilot gases with the fresh mixture with a view to reducing the axial length of the main section and in this way compensate for the inevitable increase in combustion time required for efficient burning of lean mixture.

According to this invention there is provided a gas turbine engine having an annular combustion chamber comprising annular walls extending in the direction of the axis of the chamber and defining an annular pre-mixing duct having at one axial end an annular air inlet and having at the other axial end an annular array of outlets, means for introducing fuel into the duct at the inlet end thereof thereby to generate within the duct an air-fuel mixture, walls defining a main section of the chamber situated in flow series with the duct, the latter walls being concentric with the duct and lying in positions respectively radially inwardly and outwardly of the duct thereby defining a width greater than that of the duct, the outlets being directed to discharge the mixture from the duct in directions radially inwardly and outwardly across the width of the main section, and means for igniting the mixture so introduced into the main section.

The axially directed walls of the duct allow high uniform flow velocities therethrough and in this way provide conditions avoiding premature ignition. The arrangement of the main section walls in positions radially inwardly and outwardly of the duct, and the directing of the fresh mixture from the duct radially inwardly and outwardly across the width of the main section, provide conditions ensuring substantially equal treatment of all parts of the mixture and full use of all parts of the main section. This in turn reduces the axial length necessary for the main section.

An example of a gas turbine engine according to this invention will now be described with reference to the accompanying drawings wherein.

Figure 1:
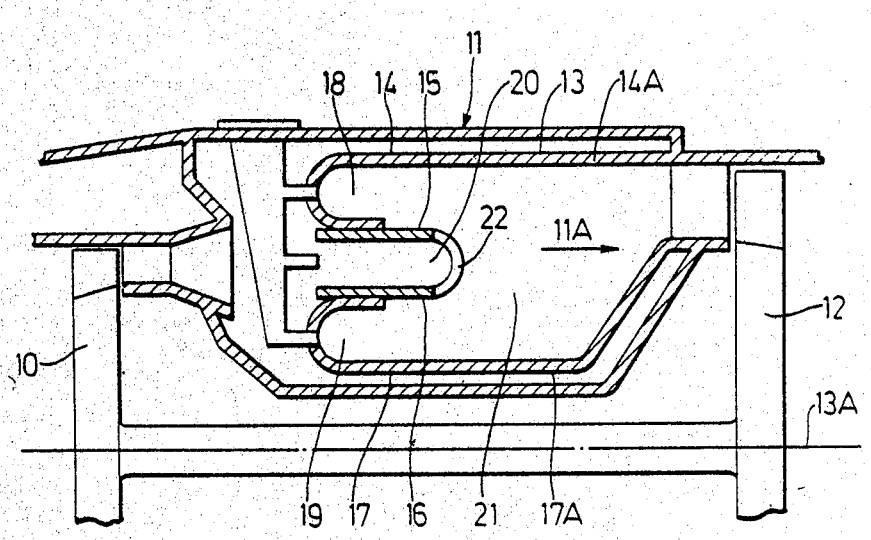
FIG. 1 is a diagrammatic sectional elevation of a part of the engine.

Referring to FIG. 1, there is shown a gas turbine engine comprising in flow series a compressor 10, a combustor 11 and a turbine 12 connected to drive the compressor. The mean direction of flow through the combustor is indicated by an arrow 11A.

The combustor comprises a combustion chamber 13 arranged annularly about an axis 13A and having two walls 14,15 defining between them an annular, radially outer, pilot section 18 of the chamber 13 and two walls 16,17 defining between them an annular, radially inner, pilot section 19 of the chamber 13. The walls 15,16 define between them an annular pre-mixing section 20, the chamber 13 has walls 14A,17A being continuations of the walls 14,17 and defining a common or main section 21 of the chamber in which flow from the pre-mixing section 20 is mixed with flow from the pilot sections 18,19. The pre-mixing section is connected to the main section through a distribution grill 22.

The arrangement of the four sections 18 to 21 is intended to provide a combustion system in which the emission of nitrogen oxide is suppressed while at the same time ensuring stable combustion. Suppression of nitrogen oxide emission is achieved by the preparation of a lean, substantially vaporized, combustible mixture in the pre-mixing section 20. Such a mixture has the low combustion temperature required for low nitrogen oxide concentration. Auto-ignition of this mixture is avoided by providing conditions of laminar flow in the pre-mixing section. Flame from the pilot sections and fresh mixture from the pre-mixing section mix in the main section for ignition of the fresh mixture and completion of burning of the pilot mixture. The pilot sections, where relatively richer mixture is burnt in conditions or recirculatory flow, provide the stability of combustion which the pre-mixed mixture does not have because of its lean composition. The distribution grill 22 is designed to ensure a uniform distribution of the flow from the pre-mixing section across the flow from the pilot sections.

Figure 2:
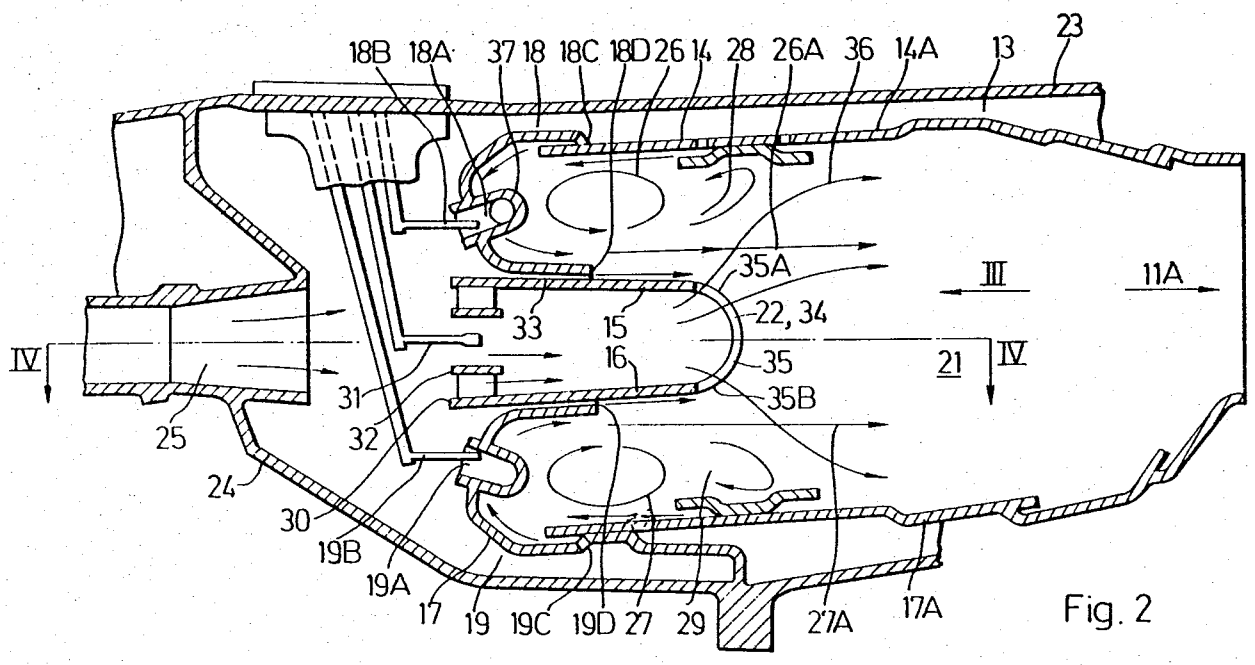
FIG. 2 is an enlarged detail of FIG. 1.
Figure 3:
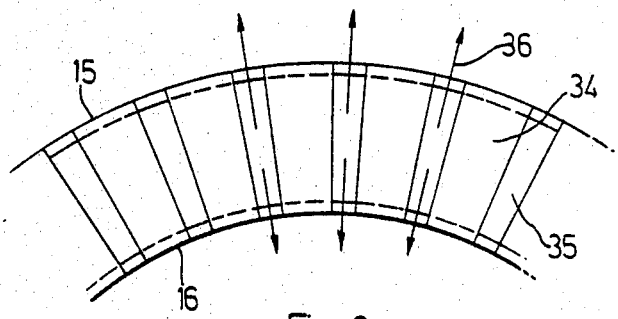
FIG. 3 is a view in the direction of the arrow III in FIG. 2 further enlarged; and, FIG. 4 is a section on the line IV—IV in FIG. 2 further enlarged.
Figure 4:
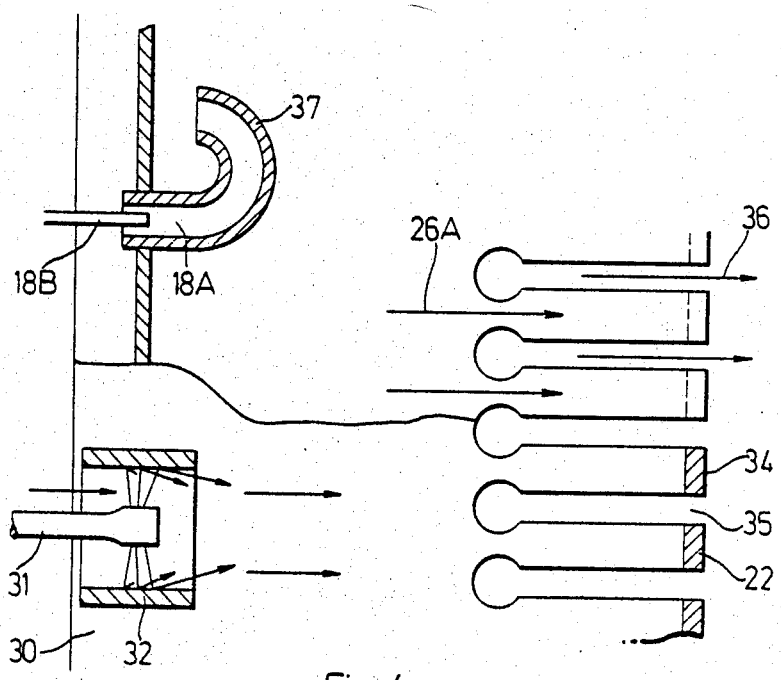

Referring now to FIGS. 2 to 4, the chamber 13 is surrounded by an air jacket 23 including at its upstream end a diffuser 24 for air leaving the compressor 10 through an annular duct 25.

The pilot section 18 has air inlets 18C provided in the wall 14 and so directed that air entering the section 18 through those inlets forms a vortex 26 thereby to provide the recirculation of flow which provides the burning mixture with the sheltered residence necessary for stable combustion over a wide range of fuel flow. The fuel itself is introduced through inlets 18B distributed annularly around the pilot section and being nozzles each supplying a spray of fuel into a respective air inlet 18A. The resulting mixture enters the pilot section through a duct 37 in which that mixture is partly vaporized. Substantial vaporization of the mixture is not intended in the duct 37. The inlets 18C also provide cooling flow along the wall 14. The wall 15 is cooled by a cooling flow through inlets 18D. An igniter is provided for igniting the combustible mixture in the pilot section on starting of the engine.

The pilot section 19 has inlets 19A,19B for fuel and air, inlets 19C for creating a vortex 27, and a cooling air inlet 19D, all corresponding to the inlets 18A,18B,18C,18D of the section 18. However, the arrangement is such that the vortices 26,27 are of opposite hand and so that the local flow of the vortices along the walls 15,16 takes place in the downstream direction, i.e. toward the main section 21. Outlets 28,29 of the pilot sections 18,19 are defined approximately between the grill 22 and the walls 14,17.

The pre-mixing section 20 has an annular air inlet 30. Fuel is introduced into the inlet 30 by an annular series of inlets 31 being nozzles which direct jets of fuel against a respective sleeve 32 surrounding the nozzle. The walls 15,16 form between them a smooth slightly convergent duct 33 of substantial length ending at the grill 22 facing the main section 21. The air-fuel mixture introduced by the inlets 30,31 is of combustible proportions and is intended to vaporize to a significant extent in the duct 33 so as to eliminate elements of liquid fuel. This is achieved by generating a very fine spray by means of the nozzles 31 and sleeves 32, and by making the duct sufficiently long for substantial vaporization to occur under the relatively high temperature of the compressed air. This process has the danger that the vapor in the duct 33 may prematurely ignite either due to the high temperature of the air or due to flame migrating from the main section through the grill 22 and along slowly moving boundary layer at the walls 15,16. Such auto-ignition and boundary layer burning would very quickly melt and destroy the walls 15,16 of the duct and are a critical condition of success of pre-mixing.

To avoid burning in the duct 33 the flow through the duct should be as nearly as possible laminar, i.e. free from turbulent regions in which velocity can reduce and flame become established. Secondly the flow velocity in the duct 33 should be higher than the propagation speed of flame in the mixture so that any flame that should occur is rapidly swept downstream into the main section. These conditions are achieved by arranging the walls 15,16 to extend substantially in direction of the axis 11A, and to be straight and continuous in that direction, so that the local flow separations occurring in curved ducts, and more likely to occur at high flow velocities, are avoided. Further, the duct 33 is arranged for its annular inlet 30 to directly confront, i.e. be on the same mean diameter as the annular compressor outlet 25. This ensures that compressor delivery air becomes available to the duct 33 with a minimum of turbulence. Further again, the duct 33 is made slightly tapered toward the grill 22, i.e. at least one of the walls 15,16 is on the sides of a cone centered on the axis 13A, the other one of the walls being either cylindrical or being also conical but in the opposite sense to the cone of the one wall. The tapered arrangement of smooth walls favours a corresponding increase in flow velocity toward the main section and a corresponding suppression of of slow boundary layer flow. The danger of flame migrating from the main section into the duct 33 is correspondingly reduced. Lastly, the duct should not be longer than is desirable for a satisfactory level of vaporization since any undue length increases the danger of auto-ignition.

The grill 22 is defined by an end wall 34 closing the downstream end of the duct except for openings 35 provided in that wall. The wall 34 is curved to be convex as seen from the main section and may be regarded as defining one half of a toroidal shape generated about the axis 13A. The openings 35 are elongate in the radial direction, having regard to the axis 13A, and face the main section 21 over a half-circle so that the openings 35 have ends 35A,35B respectively facing radially across the outlets 28,29 of the pilot sections 18,19. As a result the flow from each opening 35 is in the form of a fan 36 lying in a plane through the axis 13A, and extending substantially completely across between the walls 14,17 and of course across the outlets 28,29 of the pilot sections. The fans 36 therefore penetrate the flows, indicated 26A,27A, shed by the vortices 26,27 of the pilot sections. This results in intimate mixing between the burning pilot mixture and the fresh mixture from the pre-mixing section.

The grill 22 is also a flame trap inasmuch as flame from the main section will tend not to penetrate the flow restrictions constituted by the openings 35.

The relative mixture strengths of the pilot and pre-mixed flows are such that the mixture eventually established in the main section is sufficiently lean, say 30–40% of the stoichiometric mixture, to have a burning temperature sufficiently low for significant nitrogen oxide suppression. A certain proportion of the fuel will inevitably reach the main section in droplet form, both from the pilot or from pre-mixing sections, and will tend to burn with a locally high nitrogen oxide emission. But overall such emission is reduced. The pre-mixed mixture may absorb about 50% of the compressor delivery air and itself have a mixture strength of 50% of stoichiometric while the pilot sections have a mixture strength of 70–100% of stoichiometric.

We claim:

1. A gas turbine engine comprising a compressed air delivery duct having an outlet, a combustion chamber having an upstream end wall facing said outlet, a pre-mixing duct defined by side walls extending substantially linearly from said end wall into said chamber and defining a mean direction of flow, the chamber defining pilot sections at opposite sides of the pre-mixing duct and further defining a main section downstream of the pilot sections and of the pre-mixing duct, means provided at said end wall for introducing a pilot mixture of fuel and air into the pilot sections, the pre-mixing duct having an upstream end defining an air inlet opening and positioned to receive air from said outlet of the air delivery duct, the pre-mixing duct further having a downstream end defined by means defining outlet openings dimensioned to restrict flow from the pre-mixing duct and positioned to face across said pilot sections, means for igniting the pilot mixture to generate pilot flame, means for introducing fuel into the pre-mixing duct at said opening thereby to generate in the pre-mixing duct a pre-mixture of fuel and air which is lean compared to the pilot mixture and which is dischargeable through said outlet openings into said pilot flame as the latter passes from said pilot sections into said main section.

2. A gas turbine engine according to claim 1 wherein said pre-mixing duct has a downstream end wall extending between said side walls and said pre-mixing duct is curved in the sense of being convex when viewed from said main section, said outlet openings being defined in said pre-mixing duct end wall and being elongate in the direction between said side walls thereby to define end portions facing said pilot sections and a medial portion facing said main section, said pre-mixture in operation emerging from each said outlet opening in the form of a fan extending across the main section at the junction thereof with said pre-mixing duct end wall and said pilot sections.

3. A gas turbine engine according to claim 1 further comprising means for creating, in each said pilot section, flow of said pilot mixture along the adjacent side wall of the pre-mixing duct and toward the downstream end thereof thereby to promote mixing of the pilot mixture and the pre-mixture at the downstream end of the pre-mixing duct.

4. A gas turbine engine according to claim 1, wherein said side walls of the pre-mixing duct are mutually convergent in the downstream direction.

* * * * *